US006651875B2

(12) United States Patent
Chu

(10) Patent No.: US 6,651,875 B2
(45) Date of Patent: Nov. 25, 2003

(54) FOLDABLE TOTE BOX

(75) Inventor: Lawrence H. Y. Chu, Grapevine, TX (US)

(73) Assignee: Merryland Products, Inc., Grapevine, TX (US)

( * ) Notice: Subject to any disclaimer, the term of this patent is extended or adjusted under 35 U.S.C. 154(b) by 0 days.

(21) Appl. No.: 10/287,193

(22) Filed: Nov. 4, 2002

(65) Prior Publication Data

US 2003/0094483 A1 May 22, 2003

Related U.S. Application Data

(60) Division of application No. 09/364,028, filed on Jul. 30, 1999, now Pat. No. 6,474,541, and a continuation-in-part of application No. 09/150,402, filed on Sep. 9, 1998, now Pat. No. 5,996,885.

(51) Int. Cl.[7] ..... B65D 5/30

(52) U.S. Cl. ..... 229/191; 229/179; 229/195; 229/196; 229/918

(58) Field of Search ..... 229/122.21, 122.3, 229/125.19, 177, 178, 179, 190, 191, 195, 196, 197, 918

(56) References Cited

U.S. PATENT DOCUMENTS

| | | | | | |
|---|---|---|---|---|---|
| 1,126,246 | A | * | 1/1915 | Maier | 229/195 |
| 1,195,539 | A | * | 8/1916 | Waltz | 229/195 |
| 1,481,973 | A | * | 1/1924 | Bachmann | 229/195 |
| 2,488,705 | A | * | 11/1949 | Buttery et al. | 229/125.19 |
| 2,569,733 | A | * | 10/1951 | Ringler | 229/195 |
| 2,642,218 | A | * | 6/1953 | Platt | 229/195 |
| 2,660,364 | A | * | 11/1953 | Ferguson | 229/197 |
| 2,675,163 | A | * | 4/1954 | Buttery | 229/195 |
| 2,734,676 | A | * | 2/1956 | Lawrence | 229/125.19 |
| 3,161,343 | A | * | 12/1964 | Paige | 229/195 |
| 3,310,219 | A | * | 3/1967 | Dlugopolski | 229/191 |
| 3,682,369 | A | * | 8/1972 | Isakson | 229/195 |
| 3,883,067 | A | * | 5/1975 | McGlynn et al. | 229/179 |
| 3,918,630 | A | * | 11/1975 | Meyers | 229/191 |
| 3,953,634 | A | * | 4/1976 | Wootten | 229/195 |
| 5,184,772 | A | * | 2/1993 | McGrath | 229/179 |
| 5,649,663 | A | * | 7/1997 | Pestow, Jr. | 229/918 |
| 5,913,474 | A | * | 6/1999 | Chu | 229/167 |
| 5,996,885 | A | * | 12/1999 | Chu | 229/179 |
| 6,474,541 | B1 | * | 11/2002 | Chu | 229/196 |

FOREIGN PATENT DOCUMENTS

| | | | | |
|---|---|---|---|---|
| AU | 267468 | * | 3/1966 | 229/195 |
| SE | 088045 | * | 12/1936 | 229/195 |

* cited by examiner

*Primary Examiner*—Gary E. Elkins
(74) *Attorney, Agent, or Firm*—Jie Sha

(57) ABSTRACT

A foldable tote box is made of one-piece board of corrugated plastic. It comprises a rectangular bottom panel of two side edges and two end edges, a pair of side-wall panels, a pair of end wall panels, and two pairs of corner filler beam panels. Each side-wall panel has a folding edge integrally connected to the side edge of the bottom panel, and is folded along a first scored folding line at the folding edge, and has a cover panel connected to its top edge and two end edges defining a width of the side-wall panel and the height of the box. The end-wall panels are respectively integrally connected to and extended from the end edges of the bottom panel and folded along second scored folding lines. Each pair of corner filler beam panels is connected to the end edges of each end-wall panel. Each filler beam panels extends from the end edge of the end-wall panel and is folded along a third scored folding line to form a hollow support beam. A first pair of locking insert tabs is formed in cutting lines on the side-wall panel and engaged with a first pair of holding tabs, each of which is formed on the corresponding filler beam panel so as to secure the support beams formed of the filler beam panels against the wall of the box. Each locking insert tab and its corresponding holding tab are oriented in the same direction.

25 Claims, 15 Drawing Sheets

FOLDABLE TOTE BOX

CROSS REFERENCE

This is a divisional application of U.S. Ser. No. 09/364,028, filed Jul. 30, 1999, U.S. Pat. No. 6,474,541 that is a continuation-in-part application of U.S. Ser. No. 09/150,402, filed Sep. 9, 1998, which has been granted as U.S. Pat. No. 5,996,885. This divisional application discloses the improvement of the foldable tote box described in U.S. Ser. No. 08/949,174 that is granted as U.S. Pat. No. 5,913,474 to the same inventor and owned by the same assignee.

FIELD OF THE INVENTION

The present invention relates to further improvements of foldable box or tote box, particularly to a tote box for holding general merchandise and fresh produce. More particularly, the tote box of the present invention is formed of a board of corrugated materials, especially corrugated plastic materials, and has an improved locking system to facilitate quick assembly of the box and to enhance its stability and strength. A box cover is provided with a similar locking system for quick assembly and stability. The tote box of this invention is designed to be used not only outdoor, such as in the farmland under sunshine, raining, or even snowing weather conditions, but also indoor, such as cold storage or refrigerated transportation of goods, especially fresh produce that should be kept in special environment to preserve their quality.

BACKGROUND OF THE INVENTION

There are many kinds of boxes or cartons known in the art, that are used for holding goods for storage and transportation. These known boxes are made of various materials, such as cardboard, wood, metal, and plastics. However, all of the known boxes have, respectively, various disadvantages, such as moisture immersion, high cost, or too heavy. Particularly, none of the known foldable boxes is suitable for all environmental conditions, such as sunshine or hot environment, wet or humid conditions, cold or frozen conditions, and stacking-up with heavy load. Therefore, there is a need or demand for a durable box that can be used in any kinds of environment in which a box would be used. At the same time, the box must be cost efficient or economical, easily foldable without use of any glue, tape, nails, or tools, easily transportable as a flat piece or pieces, reusable, light weight, moisture resistant, washable, and capable of stacking-up to bear heavy load for a relatively long period of time. The box should also be recyclable.

At present, no single box can meet all of these requirements. Most of one-piece boards of foldable boxes are made of cardboard, waxed cardboard, or thin plastics because thick plastic boards cannot be easily folded. Such boxes usually utilize laminate layers or fillers to reinforce the side and end walls or corners of the box for better support, for instance, the box disclosed in U.S. Pat. No. 3,310,219 to Dlugopolski. However, the locking systems used thereon are not strong enough to hold the box panels together when the box is used in severe conditions, such as moisture, heat, and heavy load. The novel locking system of the present invention, however, can meet the requirements of strong holding and quick assembly of the box even when the box is used under the severe conditions.

The normal locking system for the boxes is tab and slot engagements that are not deadly locked. For example, the inset tabs and the slots are used in U.S. Pat. No. 3,310,219 to Dlugopolski, and U.S. Pat. No. 3,708,103 to Evants. The barbed tabs are used in U.S. Pat. No. 4,463,997 to Densen, and U.S. Pat. No. 3,991,932 to Carmel et al. These locks are designed for cardboard material that is relatively soft and flexible. The locking system of Densen is a combination of the tab-slot engagement and barbed tabs. The barbed tabs must be bend over at the box corner to assure the locking of the additional tab-slot engagement. The assembly of such box is relatively slow and such locking cannot be used on boxes of thicker plastic materials. Due to moisture immersion or merely worn-out, the tab-slot engagement or barbed tabs, even the combination thereof in Densen, will be weakened.

Therefore, it is an object of the present invention to provide an improved foldable tote box that meets all requirements stated above.

It is another object of the present invention to provide a novel locking system for foldable boxes, that facilitates the quick assembly or disassembly of the box, while provides the box with enhanced strength and stability.

It is a further object of the present invention to provide a foldable tote box that may have hollow support beams at desired locations, such as at two sides or all four sides or four corners for enhancing support strength for stacking-up boxes and providing insulation and cushion functions to absorb impacts.

SUMMARY OF THE INVENTION

In accordance with the present invention, a foldable tote box comprises a one-pierce die-cut board of corrugated material, said board including a rectangular bottom panel having a predetermined length and width defined by its two side edges and two end edges; a pair of side-wall panels, each having a folding edge integrally connected to the side edge of the bottom panel and being folded along a first scored folding line at the folding edge to form the side-wall of the box, each of said side-wall panels having a cover panel connected to its top edge opposite to the folding edge and two end edges defining a width of the side-wall panel that defines a height of the box; a pair of end wall panels respectively integrally connected to and extended from the end edges of the bottom panel and folded along second scored folding lines thereat; and a pair of filler beam panels connected to the end edges of each end-wall panel, each of said filler beam panels extending from said respective end edge of said end-wall panel and being folded along a third scored folding line at the end-wall panel end edge to form a hollow support beam; wherein a first pair of locking insert tabs is formed in cutting lines at predetermined locations on the side-wall panel and engaged with a first pair of holding tabs, each of which is formed at a predetermined location on the corresponding filler beam panel so as to secure the support beams formed of the filler beam panels against the corresponding side-wall panels when the box is assembled, and wherein each locking insert tab and its corresponding holding tab are oriented in the same direction.

Alternatively, in addition to the first pair of locking inset tabs and holding tabs, a second pair of locking insert tabs is formed at predetermined locations on said end-wall panel and engaged with a second pair of holding tabs, each of which is formed at a predetermined location on the filler beam panel. In such a case, the support beams formed of the filler beam panels are against the corresponding end-wall panels.

Each of the filler beam panels is divided into four or five sections. In one embodiment of five-section filler beam panel, the first pair of holding tabs is provided at the innermost section to the third folding lines, and the corresponding locking insert tabs are on the side-wall panel. In another embodiment of four-section filler beam panel, the second pair of holding tabs is additionally provided at the outermost section away from the third folding lines, and the corresponding second pair of locking insert tabs on the end-wall panels. In a further embodiment of four-section filler beam panel forming a triangle hollow corner support beam, the sections are somewhat equally divided, but the second innermost section is longer. The first pair of locking insert tabs is provided on the end-wall panels rather than the side-wall panels, and the first pair of holding tabs is on the third section from the third folding line.

Further, there are protruding tabs formed along the top edges of the end-wall panes and filler beam panes, while there are a pair or two pairs of openings at predetermined locations on each cover panel. The openings respectively receive the protruding tabs of the end-wall panels and filler beam panels.

The protruding tab may serve as a stacking tab formed at a top edge of each filler beam panel at a predetermined location. The function of stacking tab is disclosed in U.S. Pat. No. 5,913,474 of the same inventor and assignee. In that Patent, there are notch opening or openings at predetermined locations along the scoring lines on the end wall panel so that the tab of the filler beam panel protrudes through the notch opening or openings when the board is folded to form the box. Thus, the stacking tabs of the lower box, either on the end wall or side-wall beams, will engage with the stacking holes of the upper box to lock the upper box in position, i.e., restricting the movement of the upper box in all directions. In addition, the protruding tabs in the embodiments of the present invention also engage with the openings on the cover panels to secure the cover on the box.

The novel locking system includes a locking insert tab or tabs formed at an appropriate location of the end-wall panel or sidewall panel. The holding tab or tabs are formed on one of sections of the filler beam panel. Thus, the locking insert tab may be pressed and inserted through and held by the holding tab on the hollow support beam formed of the filler beam panel. The insert tab is oriented in the same direction as the holding tab when the box is assembled, that is, a corresponding locking insert tab and holding tab are oriented in the same direction as the tabs engage with one another. The insert and holding tabs are generally cutout in a U-shape shape at appropriate location on the side or end walls and filler beam panels. The length of the insert tab is a little bit longer than the holding tab on the support beam. Due to the elasticity of the corrugated board or plastic board, the holding tab on the support beam will hold the insert tab against the wall of the support beam once the insert tab is pressed and inserted through the holding tab which is moved away, by pressing, from its original position and tends to return the original position on the support beam.

Further, a cover piece can be provided with the novel locking system. The cover piece includes nine panels of a top panel, two side panels, two end panels, and four corner panels that are integrally connected to either end panels or side panels. The locking insert tabs are provided on the side panels if the corner panels are connected to the end panels or vice versa. The holding tabs of the locking system are formed on the corner panels.

Various embodiments of the present invention can be well understood in the following descriptions in connection with the accompanying drawings.

DETAILED DESCRIPTION OF THE INVENTION

Figure 1:
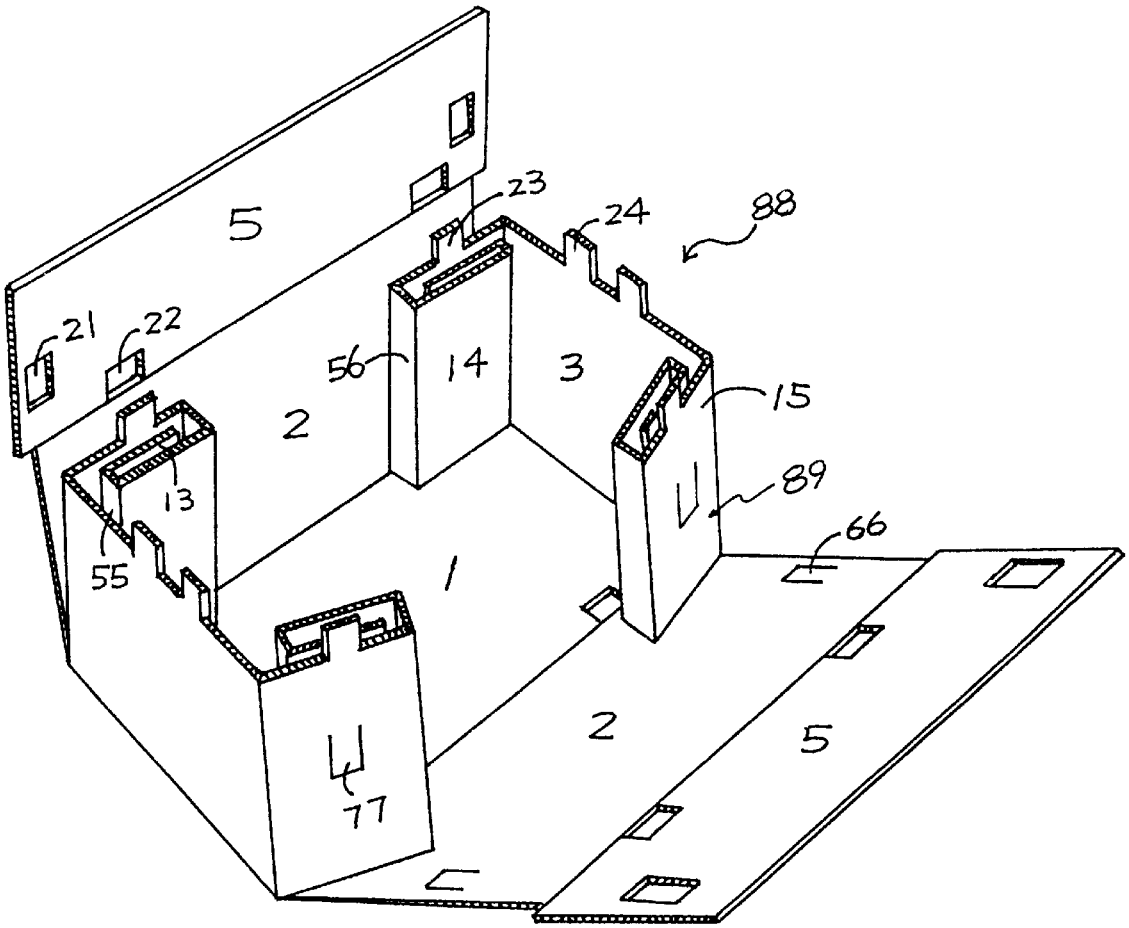
FIG. 1 is a perspective view of the first alternative embodiment of the foldable tote box of the present invention, having support beams at two sidewalls and the new locking system in a process of assembling.
Figure 2:
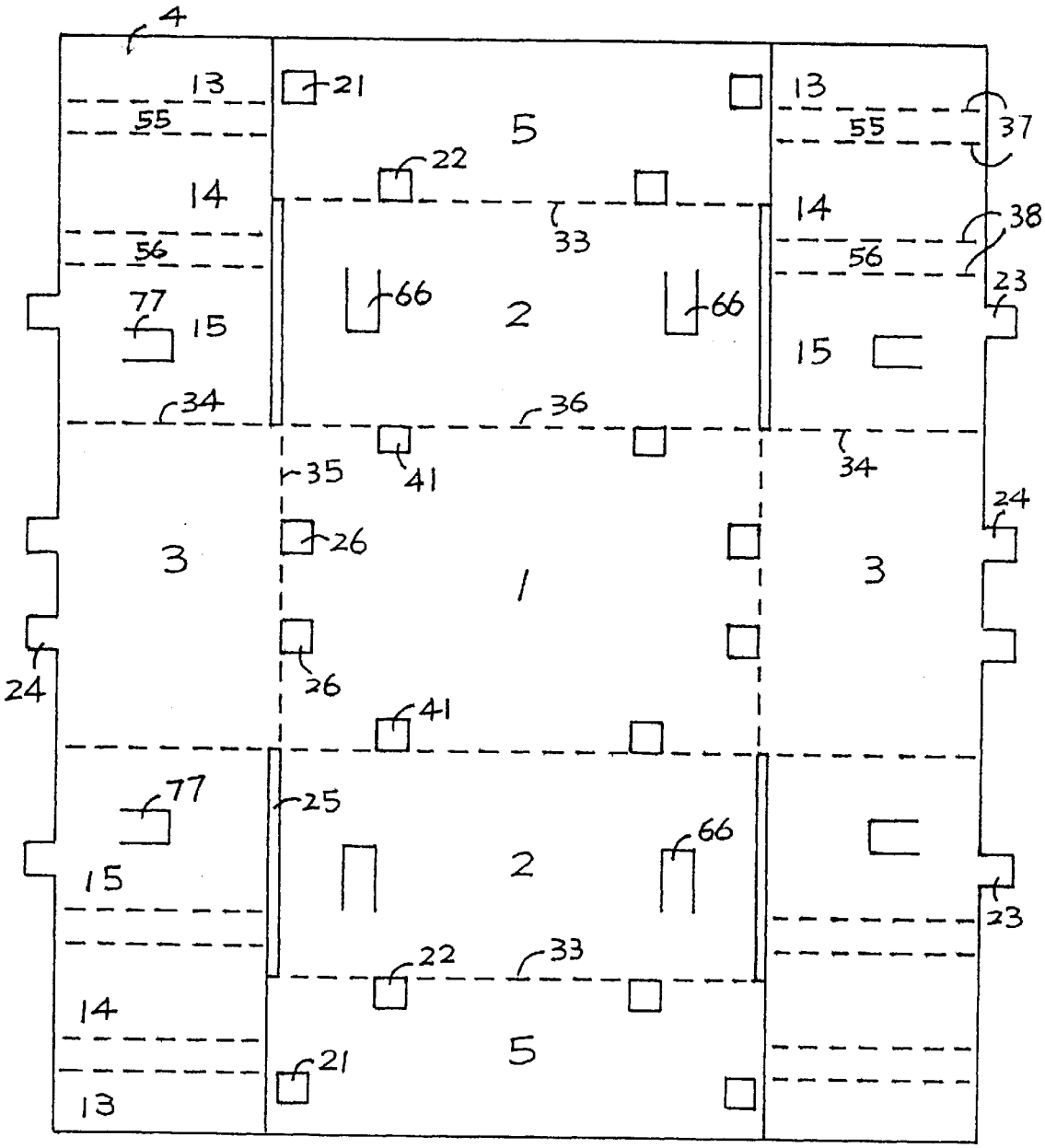
FIG. 2 is a plane view of the first embodiment of the foldable tote box board of the present invention.

FIGS. 1 and 2 generally illustrate the first embodiment of tote box 88 of the present invention. The box 88 of the first embodiment of the present invention, as shown in FIG. 1, includes a bottom 1, two end-walls 3, and two sidewalls 2 that are reinforced by hollow support beams 89. On each sidewall, the locking insert tabs 66 are provided. Each locking insert tab is pressed and inserted through a holding tab 77 provided on the hollow support beam 89 at a section 15 mating the side wall 2, thereby engaging with the holding tab 77. There are protruding tabs 23 provided at the mating section 15 of the filler beam panel 4 that forms the hollow support beam 89. Protruding tabs 24 are provided at the top edge of each end wall 3. Connected to the top edge 33 of each sidewall is a cover panel 5, on which several openings are formed to receive the protruding tabs 23 and 24.

FIG. 2 shows a one-piece board of the box 88 of the first embodiment of the present invention. The board is a one-piece die-cut and scored board of corrugated materials, preferably corrugated plastic materials. FIG. 2 shows the flat board of unassembled foldable tote box. The board comprises a bottom panel 1 with two end edges and two side edges defining the size of the box. Two end wall panels are, respectively, connected to the end edges and foldable along first scoring lines 35 of the bottom panel 1, and two side-wall panels 2 are, respectively, connected to the side edges and foldable along second scoring lines 36 of the bottom panel 1. A pair of filler beam panels 4 is connected, respectively, to side edges of the end-wall panels 3, and foldable along third scoring lines 34.

Each of the filler beam panels 4 is divided in various ways, for instance, into five sections 13, 14, 15, 55, and 56 as shown in FIG. 2. The innermost section 15 is provided with the holding tab 77, that may mate with the locking insert tab 66 on the sidewall panel 2. The section 55 and 56 are defined, respectively, by double scoring lines 37 and 38 that separate the sections 13, 14 and 15. The double scoring lines 37 and 38 or the sections 55 and 56 define the thickness of the hollow support beam 89 of the tote box, while the mating section 15 defines the width of the support beam 89.

The first pair of locking insert tabs 66 of the novel locking system is formed by cutting lines on the sidewall panel 2. The locking insert tabs 66 are parallel with the side edges of the sidewall panel 2. Each of the first pair of holding tabs 77 is formed on the mating section 15, and oriented in the same direction with the first locking tabs when the box is assembled.

Figure 3:
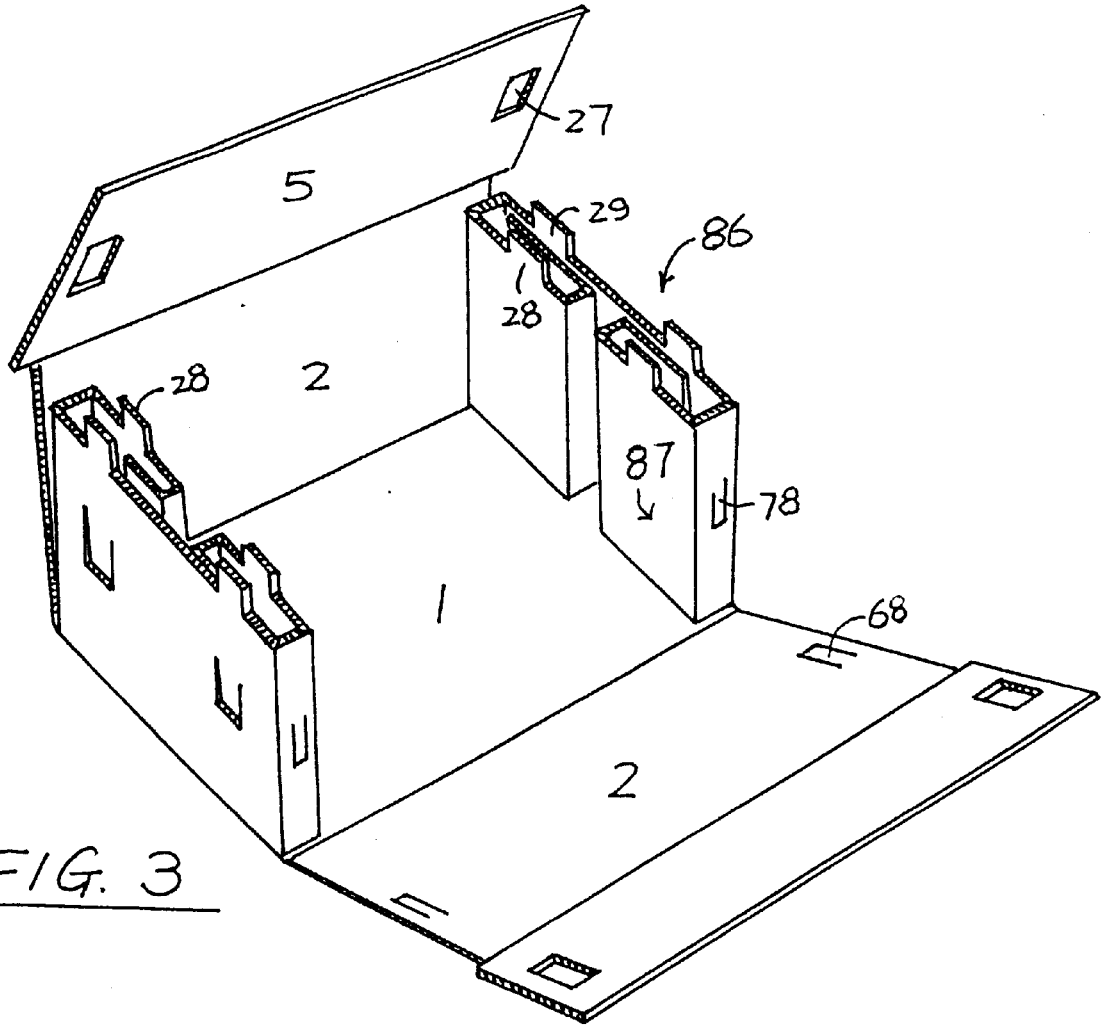
FIGS. 3 and 4 are perspective views showing the assembling process of the second alternative embodiment of the box, having the support beams formed of the filler beam panes at the box end walls.
Figure 4:
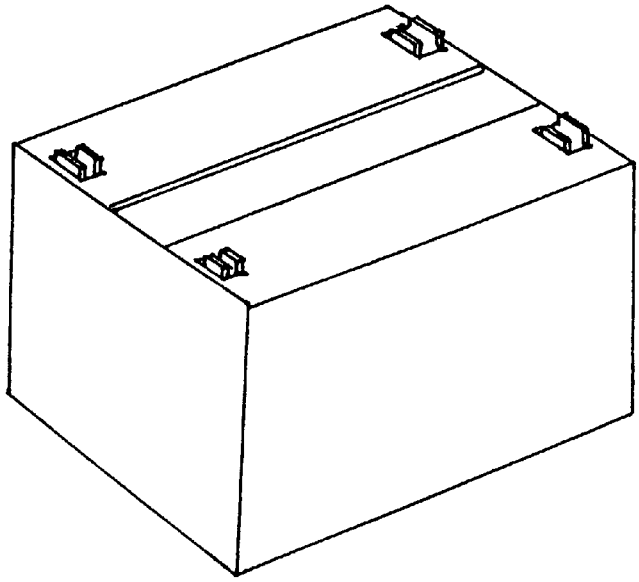
Figure 5:
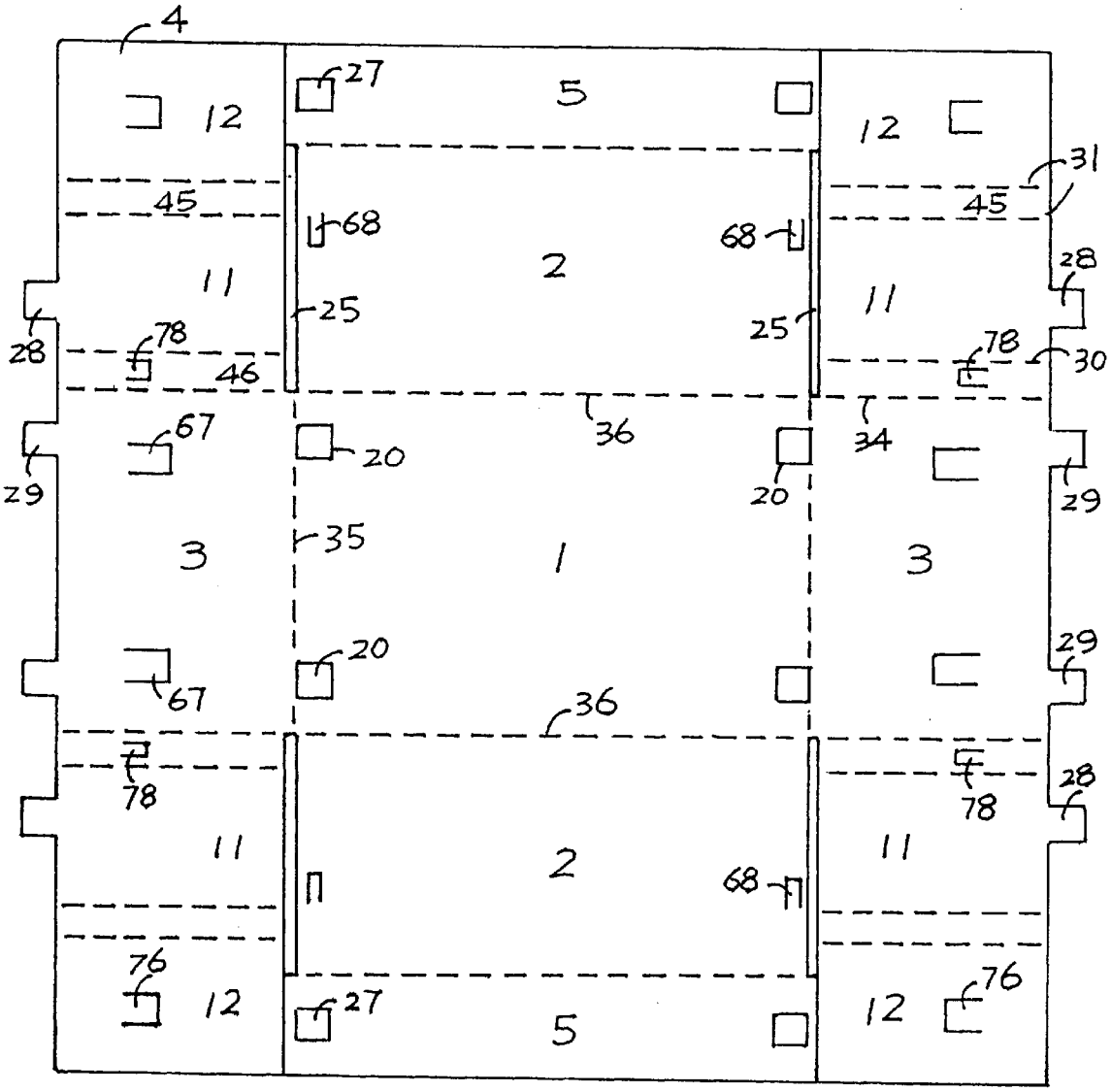
FIG. 5 is a plane view of the second embodiment tote box board of the present invention.

FIGS. 3 and 4 show the second alternative embodiment box 86 of the present invention in the process of assembling, and FIG. 5 shows the board of the second embodiment. In addition to the first pair of locking insert tabs 68 on the side-wall panel 2, there is a second pair of locking insert tabs 67 provided on the end-wall panel 3. Accordingly, there is a second pair of holding tabs 76 formed on the outermost section 12 of the filler beam panel 4, while the innermost section 46 has the first holding tab 78.

In this embodiment, the scored folding lines 30 and 31 divide the filler beam panel into four sections 46, 11, 45, and 12. The innermost section 46 is a narrow section that defines the thickness of the support beam 87 formed of the filler beam panel. The outermost section 12 is the section mating the end-wall panel 3. Hence, The protruding tabs 28 and 29 are located at appropriate locations along the respective edges of the filler beam panel and end-wall panel, that is different from the protruding tabs 23 and 24. There is a pair of openings 27 located on the cover panel 5, that is different from the openings 21 and 22 in the first embodiment. The openings 27 are larger in size to receive two tabs 28 and 29 when the box is assembled as shown in FIGS. 3 and 4.

Figure 6:
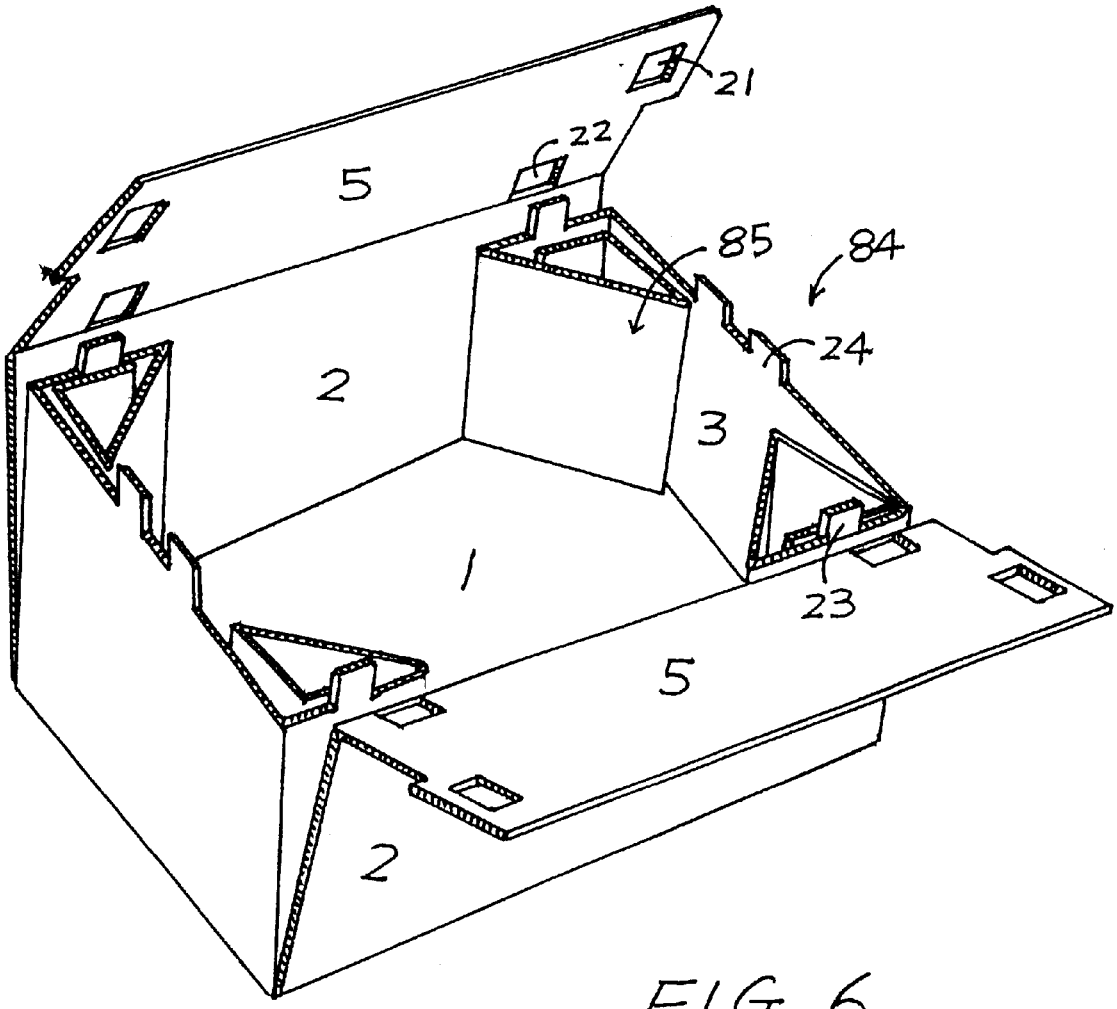
FIG. 6 is a perspective views showing the assembling process of the third alternative embodiment of the box having triangular support beams formed at all four corners of the box.
Figure 7:
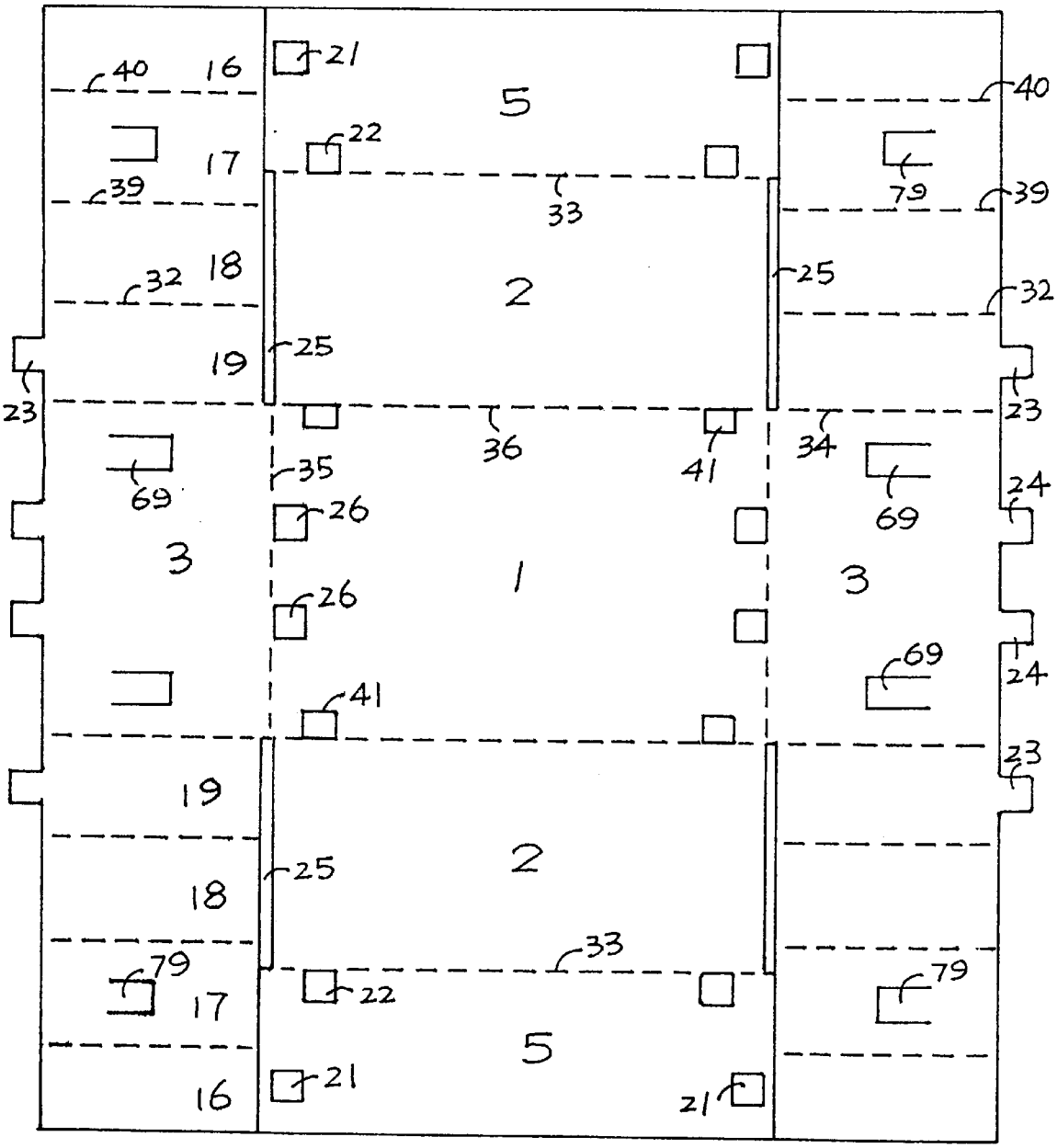
FIG. 7 is a plane view of the third embodiment box board shown in FIG. 6.

In the third embodiment of the present invention shown in FIGS. 6 and 7, the hollow support beams are triangle columns 85, each of which is located in a corner of the box. The box 84 has most of the panels similar to the box 89 of the first embodiment except the differently shaped support beams. The locations of the protruding tabs 23 and 24 and the openings 21 and 22 of the cover panel 5 are similar to those in the first embodiment as seen in FIG. 6.

The filler beam panel, however, is different from the beam panel of the first embodiment. The filler beam panel forming the triangle support beam 85 is divided into four sections 16, 17, 18, and 19 of similar width by the scored folding lines 32, 39, and 40. The second innermost section 17 is wider than others to form the diagonal side of the triangular beam. The holding tab 79 is provided on the third section from the third folding lines 34. The locking insert tab 69 is formed on the end-wall panel similar to the locking insert tab 67 of the second embodiment.

All of the above three embodiments include the integrated cover panels 5 so as to eliminate the use of a separate box cover. Thus, these embodiments are different from the ones disclosed in the prior application U.S. Ser. No. 09/150,402, which would require separate box covers. The above first and second embodiments illustrate the possible locations of the hollow support beams along the sidewalls or end walls of the box such that people can choose an appropriate box to accommodate various things which may have specific requirements for bearing weight or preventing impact from different directions. Likewise, the third embodiment may provide protection from all directions, such as preventing shacking and absorbing impact at box corners.

The die-cut and scored board of the tote box of the present invention is manufactured by die-cutting a piece of corrugated plastic board, that has smooth surfaces on both sides to obtain the bottom panel, end wall panels, side-wall panels, and filler beam panels or corner panels, and to obtain, at the predetermined locations, all of the scoring lines mentioned above, and the locking insert tabs and holding tabs of the novel locking system as discussed above. If desired, there may be some die-cuts for handle-receptacles and venting apertures.

As seen in FIGS. 2, 5 and 7, there is a slot 25 formed between the filler beam panels and the sidewall panels. This slot is provided to facilitate folding of the filler beam panels to form the hollow support beams, and to facilitate the assembly of the box because the board has certain thickness. In some cases, the flutes of the corrugated board are oriented vertically when the box is assembled as seen from the sides of the support beams 89, 87, and 85. In the prior application Ser. No. 09/150,402, each of the end wall panels is folded upward and has a flap section folded over the hollow beams such that the beams are embraced by the flap section against the end wall section. The portion resting on the top of the support beams provides a wider and stable support surface. When the flap section is being closed to the hollow beams, the locking insert tabs can be pressed and inserted against the holding tabs on the beams so that the holding tabs are bent inwardly and the insert tabs are inserted into the hollow beams. Due to the elasticity, the tabs tend to return their original positions, that is, to be flash with the respective surfaces of the inner beam section and flap section once the pressing is released.

In the embodiments of this application, the locking insert tabs are directly formed on the end-wall panel or the side-wall panel. The flap section of the end-wall panel of the prior application has been eliminated. The strong support can still be obtained by the hollow support beams in connection with the cover panels.

As seen in FIGS. 8–11, the locking insert tabs 66 are made a little bit longer than the holding tabs 77, while the holding tabs 77 are a little bit wider than the insert tabs 66. Therefore, once the insert tabs 66 pass through the corresponding holding tabs 77 and get into the respective hollow beams, each insert tab 66 will be held by the holding tab 77 against the corresponding section of the filler beam panel. All other locking insert tab and holding tab engagements are the same as the engagement of the locking insert tab 66 and holding tab 77, but at different locations.

It can be understood that the locking insert tabs and holding tabs can be formed at any appropriate locations on an appropriate section of the support beam or filler beam panel as seen in the various embodiments of the present invention. Thus, it is different from the conventional tab-slot and tab—tab engagement that have to be near the corners of the box. The locking system of the present invention can be applicable to the connection of any two parallel panels so long as both panels may have corresponding portions to be cut out to form the tabs pointing in the same direction, and the wider tab may hold on the longer tab. This is shown in detail in FIGS. 8–11.

It can be understood that any handle-receptacle can be formed by die-cut. The handle-receptacle is normally located on the end-wall panel at a position that will be suitable for handling, and sometimes, it is between the support beams constructed by the filler beam panels. Other kinds of apertures can be formed during the die-cutting to meet various needs for transporting fresh produce or storing sea food.

Figure 10:
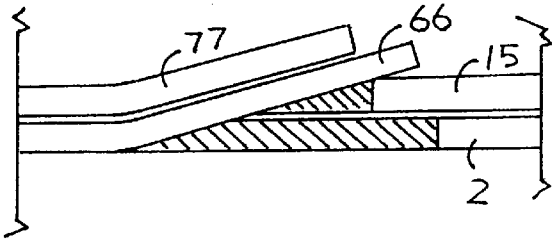
FIGS. 8, 9, 10 and 11 illustrate, respectively, the shape and engagement of the insert tab and holding tab of the new locking system of the present invention.
Figure 11:
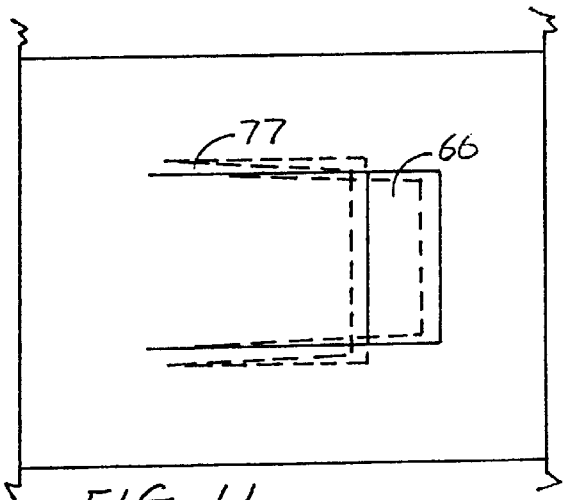
Figure 8:
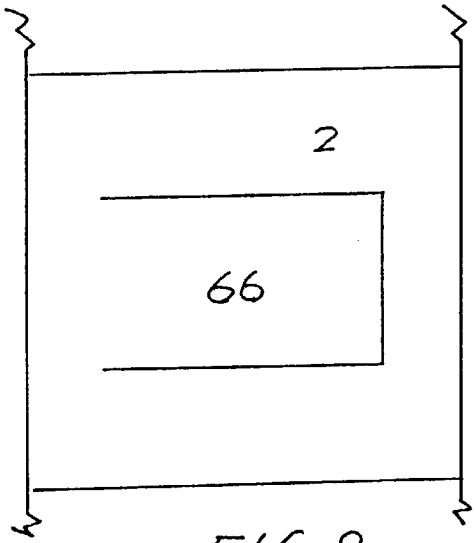
Figure 9:
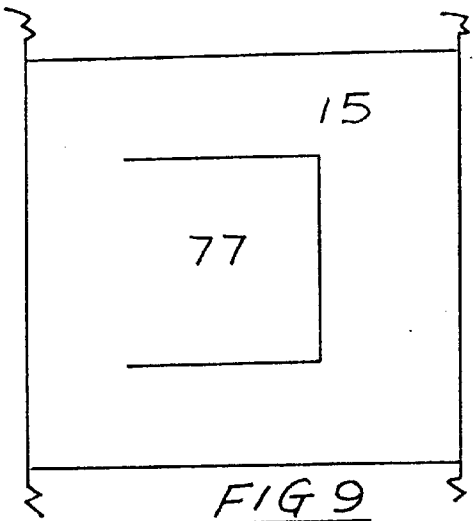

FIG. 8 shows the locking insert tab 66 of the novel locking system of the present invention. The holding tab 77 is shown in FIG. 9. As illustrated, the holding tab 77 is wider than the locking insert tab 66, while the insert tab 66 is longer than the holding tab 77. The insert tab 66 and holding tab 77 are, respectively, formed by cutting out a U-shape, at predetermined locations, on the side-wall or end-wall panel and on the filler beam panel. Normally, they are defined by the predetermined U-shaped cut-through lines, and lie in the same plane with the surfaces of the respective panels. FIGS. 10 and 11 show the side view and plane view of such engagement. It can be understood that due to the reversed locking tab engagement, the novel locking system can tightly hold the assembled box in the predetermined shape. It is not easy to cause disengagement of the locking tabs by any accident. The tabs must be pressed into the hollow beam and pulled out by hand in an opposite direction from the insertion.

Figure 10A:
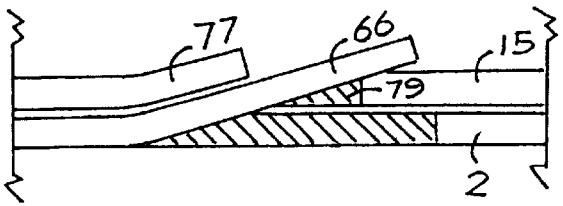
FIGS. 8A, 9A, 10A, and 11A illustrate, respectively, the alternative shape of the holding tab, and engagement of the locking tab and holding tab.
Figure 11A:
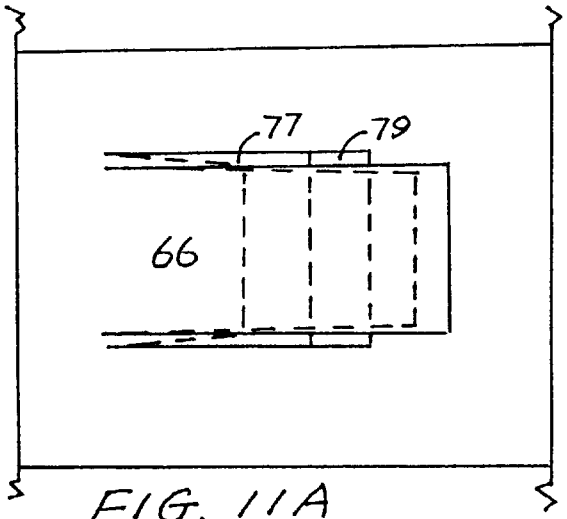
Figure 8A:
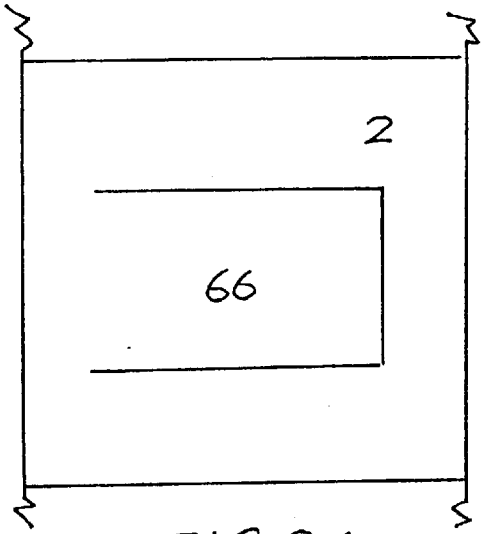
Figure 9A:
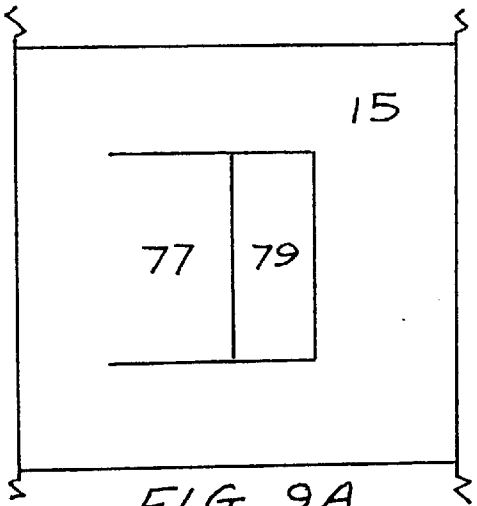

FIGS. 8A, 9A, 10A, and 11A show an alternative arrangement of the locking and holding tabs. The holding tab 77 is made a little bit short such that a slot 79 is formed to facilitate the insertion of the locking tab 66. As seen in FIG. 10A, the shorter holding tab 77 will give a lower profile for the locking and holding tabs engagement.

Further, the locking insert tabs 66 and holding tabs 77 will return to their original positions when the box is disassembled. Each tab again appears to be a U-shaped cutting line. These locking and holding tabs form the integrity of the respective panels. Thus, they will not be easily distorted. Therefore, the foldable tote box having the novel locking system of the present invention can be reused many times. It can be understood that this locking system can be used in any kind of box, not necessarily in boxes of corrugated plastic materials. Nonetheless, the locking system may function better in the boxes of plastic materials or corrugated materials. With precise design, the holding tab 77 can be made a little bit wider than the insert tab 66, and the insert tab 66 is made a little bit longer than the holding tab 77 so as to assure the tight engagement thereof.

Figure 12:
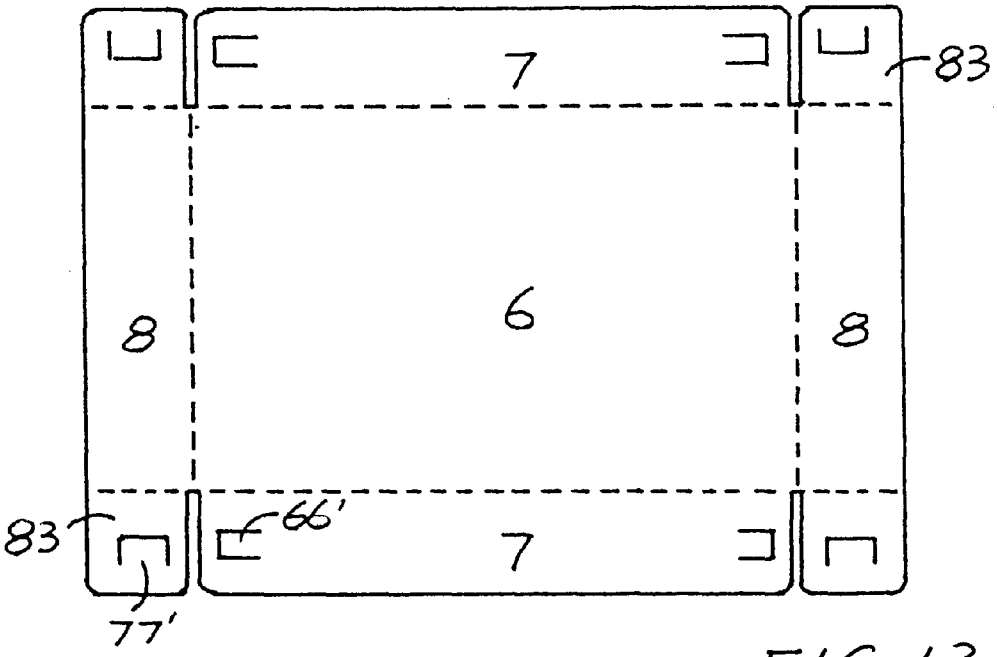
FIG. 12 is a plane view of a box cover board provided with the new locking system of the present invention.
Figure 13:
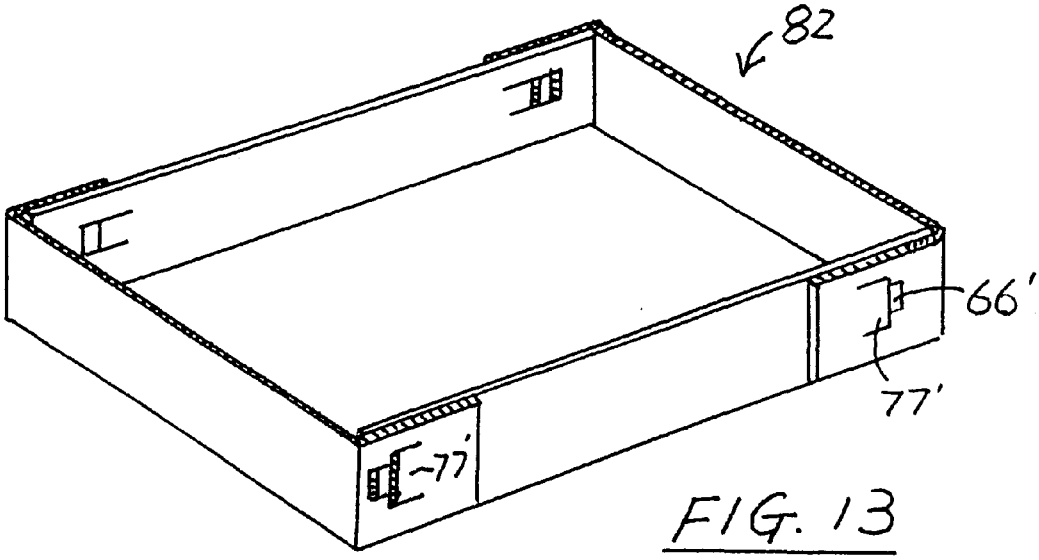
FIG. 13 is a perspective view of the box cover assembled with the new locking system of the present invention.

Furthermore, a cover piece can be provided with the same novel locking system. As shown in FIGS. 12 and 13, the cover piece is formed of nine panels including a top panel 6, two side panels 7, two end panels 8, and four corner panels 83 that are integrally connected to either end panels or side panels. The holding tabs 77' are provided on the corner panels 83. The locking insert tabs 66' are provided on the side panels 7 if the corner panels 83 are connected to the end panels 8. The locking insert tabs 66' of the cover may be provided on the cover end panels 8 if the corner panels are connected to the cover side panels 7. FIG. 13 shows the assembled cover 82 with the engaged tabs pointing toward the end wall of the box cover 82.

Figure 14:
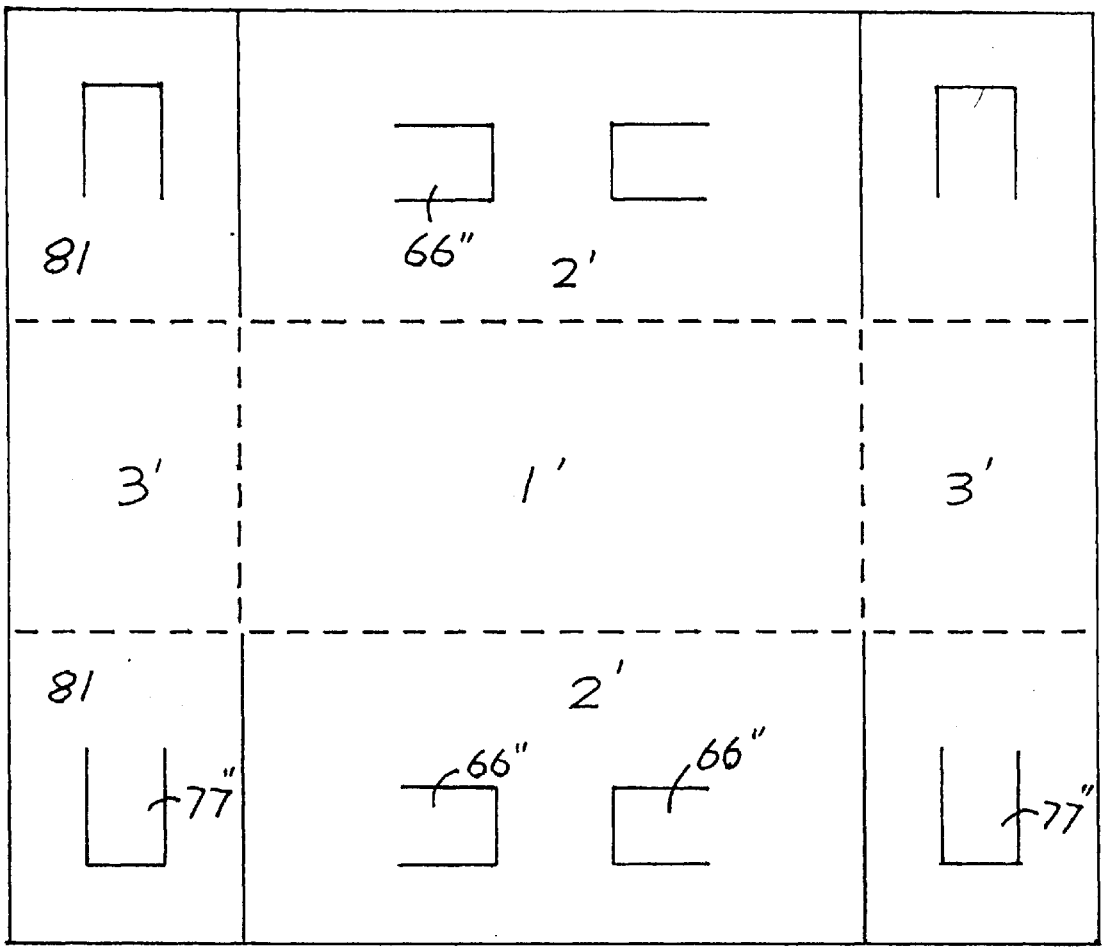
FIGS. 14 and 15 show, respectively, a plane view of a box board and a perspective view of the fourth box embodiment of the present invention, which includes a similar structure of the box cover shown in FIGS. 12 and 13, but the panels have larger scale to form a box instead of a cover.
Figure 15:
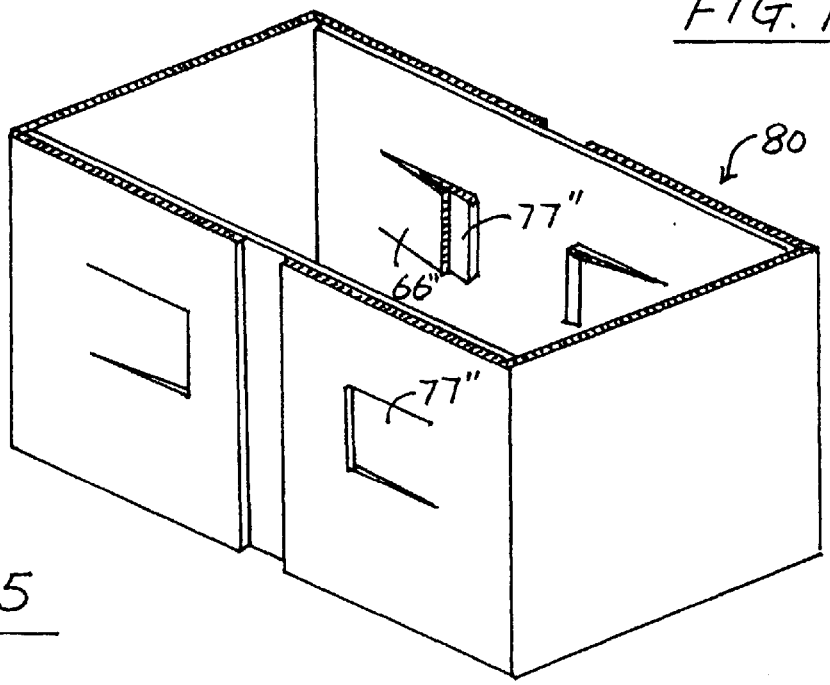

The fourth embodiment of the box and board are, respectively, shown in FIGS. 14 and 15. The orientations of the locking insert tab 66" and holding tab 77" in FIGS. 14 and 15 are different from the orientations of the tabs in FIG. 13. They have been turned 180 degrees from the direction pointing toward the end wall in FIG. 13, to the direction pointing away from the end wall as seen in FIG. 15. In the box of FIGS. 14 and 15, the respective panels are just larger in scale than the panels of the cover piece of FIGS. 12 and 13. The orientation of the tabs pointing away from the end-wall panel enables the assembling and disassembling of the box with ease, but can still hold the panels together. The fourth embodiment illustrates that if the side panels and end panels are enlarged in size, a foldable box without hollow support beams can be formed by using the new locking system.

Figure 16A:
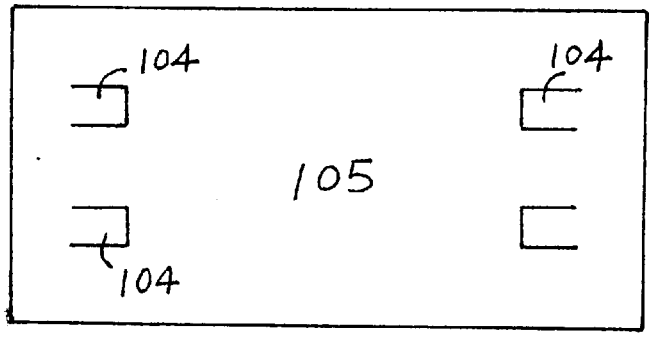
FIGS. 16A and 16B shows the fifth box embodiment of the present invention, including two kinds of separate boards, respectively, for end walls and side walls.
Figure 16B:
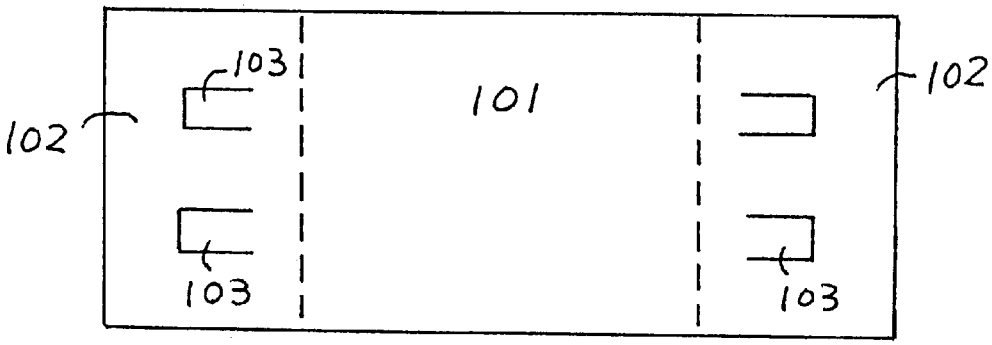
Figure 17:
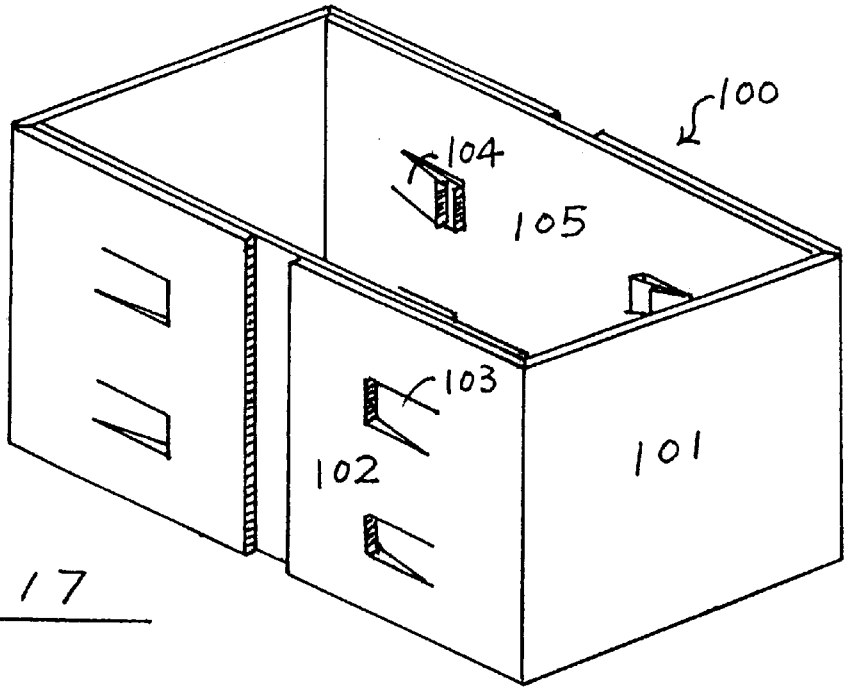
FIG. 17 shows the assembled box of the fifth embodiment, including only end walls and side walls and having the tabs oriented in a direction different from those directions shown in the previous figures.
Figure 18:
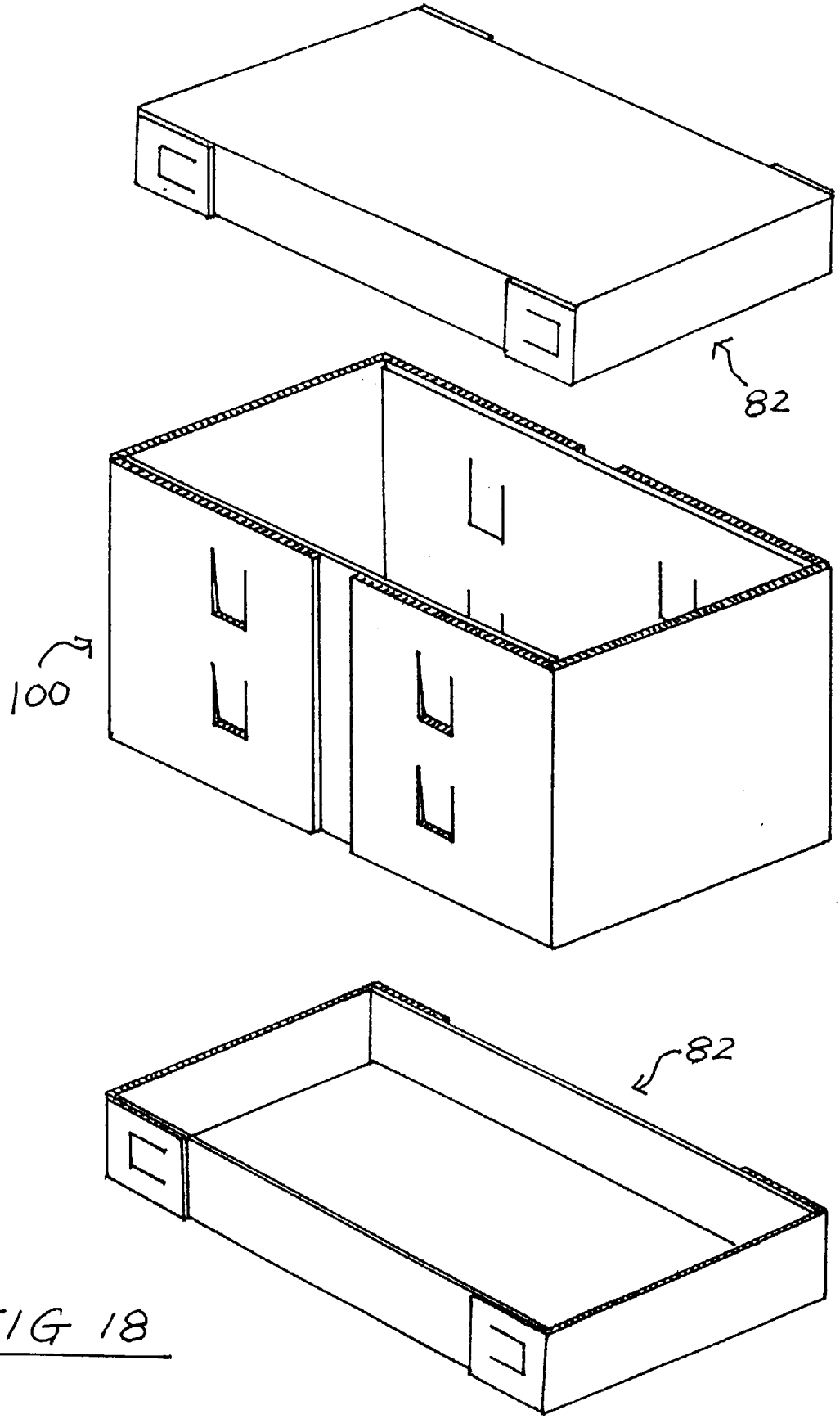
FIG. 18 is a perspective view of the box of the fifth embodiment in assembling with two box covers.

FIGS. 16A and 16B show the use of the novel locking system on two types of separate panels for the box 100 of the fifth embodiment of the present invention. A side wall panel 105 has four holding tabs (or locking insert tabs) 104, and an end-wall panel 101 has two folding corner wing panels 102. The corner panel 102 has two corresponding locking insert tabs (or holding tabs) 103. FIG. 17 shows the assembled box of the fifth embodiment using two sidewall panels of FIG. 16A and two end-wall panels of FIG. 16B. The orientation of the tabs is different from that of the cover of FIG. 13, but same as that of the box of FIG. 15. This enables the stable construction of the box from a number of panels. The locking and holding tabs can also be oriented as seen in FIG. 18, in which the tabs turn 90 degrees away from the direction as shown in FIG. 17. FIG. 18 also illustrates the box 100 of the fifth embodiment of the present invention in assembling with two box covers of FIGS. 12 and 13.

Figure 19:
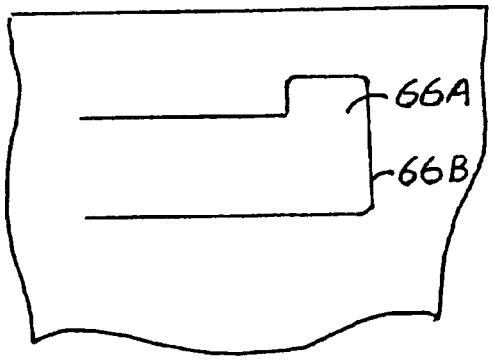
FIGS. 19–21 show the optional tab arrangement of the locking system of the present invention.
Figure 20:
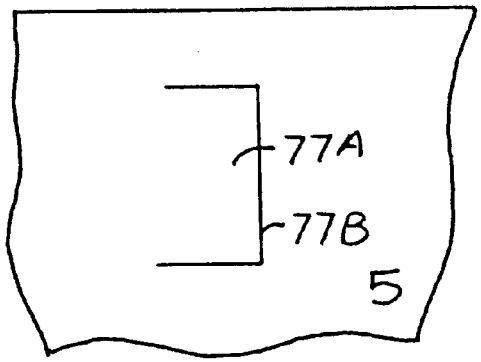
Figure 21:
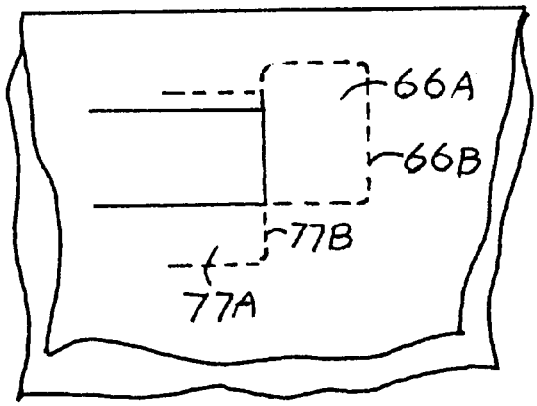

Moreover, FIGS. 19 to 21 show the alternative locking insert tab 66 that is much narrower than the holding tab 77. The narrower insert tab 66 may assist easy insertion. In this situation, the holding of the engaged tabs 66 and 77 might not strong enough. Hence, the locking inset tab 66 is made of a turn over portion 66A, i.e., a barbed head portion. The barbed portion 66A has its tip edge 66B smaller than the tip edge 77B of the holding tab portion 77A.

Figure 22:
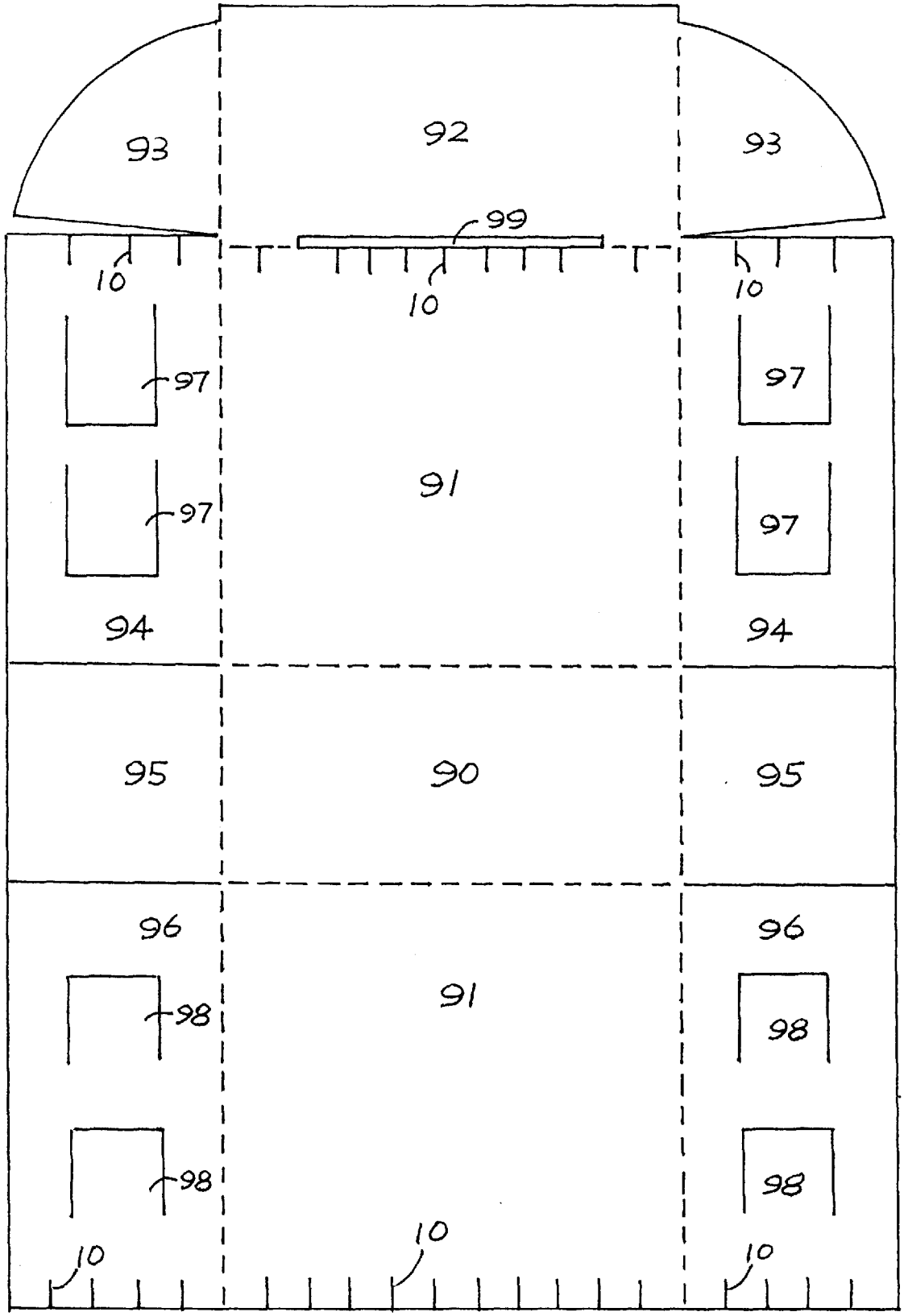
FIGS. 22–24 show the sixth embodiment of the present invention, illustrative of alternative usage of the novel locking system of the present invention.
Figure 23:
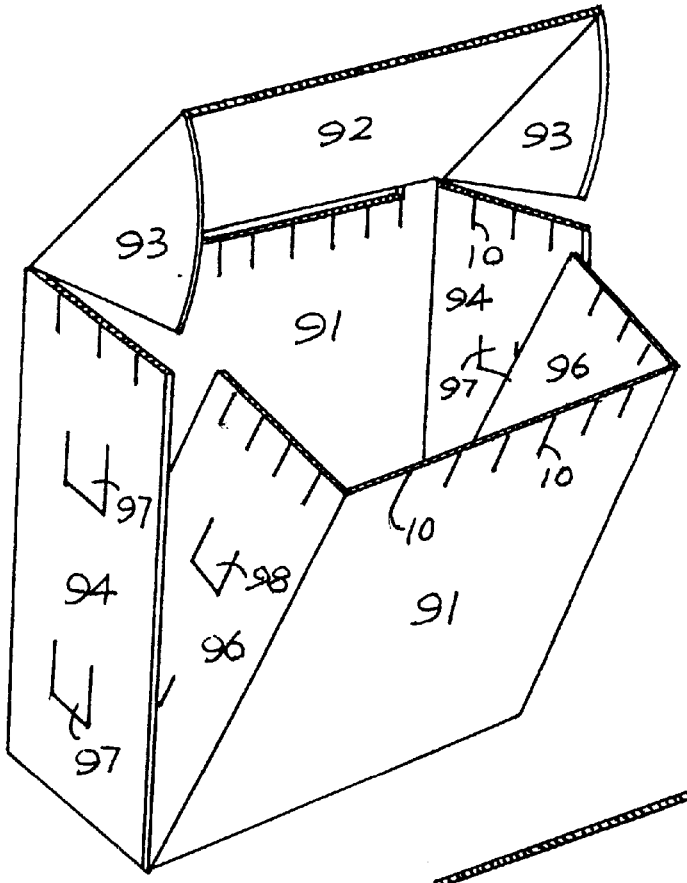
Figure 24:
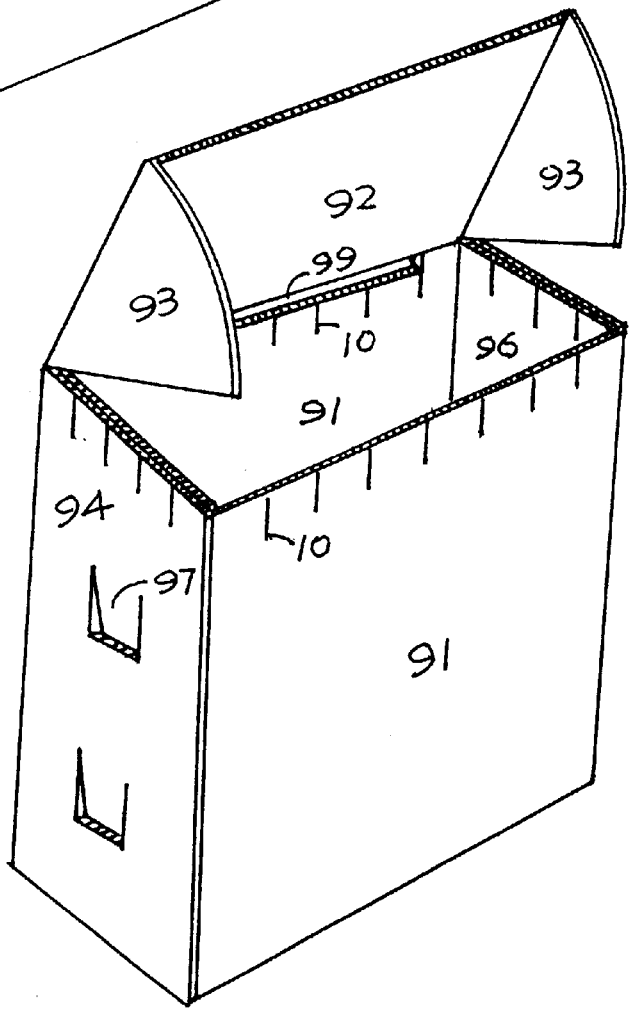

FIGS. 22 to 24 show the sixth embodiment of the present invention. It is different from any of the previous embodiments, but uses the same locking system. FIG. 22 shows that the differently sized panels can construct a different box to fulfill different needs. In this case shown in FIGS. 23 and 24, the box can be used as a trash box or box for recycling goods for the environmental protection purposes, or a convenient box. As seen, on each corner panel there is one or two locking or holding tabs 97 and 98. When assembled, the corner panels 94 and 96 come together to form the end wall of the box, while the end-wall panels 95 are folded within the box as reinforcing panels. The cover panel 92 with the insert panels 93 is folded over to cover the opening of the box. The cover panel 92 is certainly optional. The provision of a plurality of cuts 10 enables the clipping or clamping of any thin sheet of flexible materials, such as plastic sheet or bag rim at any desired cuts to hold the bags thereat. For instance, one box can hold one, two or even more bags for different recyclable things. In any event, there is no need of using any tools, adhesive tapes, glue, nails to assemble the tote box.

The above box cover and fourth, fifth and sixth embodiments further demonstrate that such a two-tab locking can be provided at any surfaces or locations on any two panels to be connected. Thus, such locking locations can be on side or end panels and corresponding corner panels. The locking locations can be on the separate panels with or without filler beam panels as shown in the figures.

The primary features of the box of the present invention have been described above. The box of the present invention has superior properties over the conventional boxes in terms of stable support. The one-piece board enables the easy storage of the board before the boxes are assembled for use. The durability of the corrugated plastic material gives the box of this invention the properties of moisture resistant, washable, repeatedly reusable, and capability of undertaking heavy load. The box of this invention can be used not only outdoor in raining or snowing days, but also in cold storage or refrigerated transportation of goods, especially the fresh produce, meat or seafood so as to preserve the quality of the fresh produce.

Further, the strong plastic material and the strong support beams of the box can protect the fresh produce in the box from being squeezed by outside force. The hollow support beams, either on the end walls of the box or on its four sides, may serve as cushion to absorb any impact on the box, or insulation against sunshine heat or any kind of cold.

The novel locking system can assist the quick and smooth assembly of the box, and provide stable locking for the assembled box. The smooth appearance of the locking tabs of the present invention may give the box board better integrity.

It can be understood that the box of the present invention as cut-out in various ways described above may be assembled by using any suitable means, such as adhesive tape, glue etc. in place of the locking and holding insert tabs, or at any appropriate locations on the side-wall or end-wall panels or corner or filler beam panels or even bottom panel. Such substitutes are also within the scope of the present invention of one-piece box board having at least nine panels with corner panels forming hollow beams in association with the particular scored lines as disclosed above.

I claim:

1. A foldable tote box comprising a one-pierce die-cut board of corrugated material, said board including a rectangular bottom panel having a predetermined length and width defined by its two side edges and two end edges; a pair of side-wall panels, each having a folding edge integrally connected to the side edge of the bottom panel and being folded along a first scored folding line at the folding edge to form the side-wall of the box, each of said side-wall panels having a cover panel connected to its top edge opposite to the folding edge and two end edges defining a width of the side-wall panel that defines a height of the box; a pair of end wall panels respectively integrally connected to and extended from the end edges of the bottom panel and folded along second scored folding lines thereat; and a pair of filler beam panels connected to the end edges of each end-wall panel, each of said filler beam panels extending from said respective end edge of said end-wall panel and being folded along a third scored folding line at the end-wall panel end edge to form a hollow support beam; wherein a pair of locking insert tabs is formed in cutting lines at predetermined locations on the side-wall panel and engaged with a pair of holding tabs, each of which is formed at a predetermined location on the corresponding filler beam panel so as to secure the support beams formed of the filler beam panels against the corresponding side-wall panels when the box is assembled, and wherein each locking insert tab and its corresponding holding tab are oriented in the same direction.

2. The foldable box of claim 1, wherein each of said filler beam panels is divided into five sections by scoring lines, each of the corresponding holding tabs being provided at the innermost section to the third folding line.

3. The foldable box of claim 1, further comprising protruding tabs formed along the top edges of the end-wall panels and filler beam panels, and wherein there are two pairs of openings formed at predetermined locations on each cover panel, thereby receiving, respectively, the protruding tabs of the end-wall panels and filler beam panels when the box is assembled, and wherein there are formed openings on the bottom panel of the box, and the protruding tabs protrude through the openings of the cover to serve as stacking tabs to hold an upper stacked box in place.

4. The foldable box of claim 1, wherein the locking insert tab is generally in form of a U-shaped cutting line, and is longer than the holding tab, while the holding tab is wider than the locking insert tab such that upon pressing the locking insert tab and the holding tab away from their original positions, the holding tab is bent into the hollow beam and leaves an opening to let the insert tab slide through, and upon releasing the pressing, a portion of the insert tab s held by the holding tab against the hollow beam.

5. A foldable tote box comprising a one-pierce die-cut board of corrugated material, said board including a rectangular bottom panel having a predetermined length and width defined by its two side edges and two end edges; a pair of side-wall panels, each having a folding edge integrally connected to the side edge of the bottom panel and being folded along a first scored folding line at the folding edge to form the side-wall of the box, each of said side-wall panels having a cover panel connected to its top edge opposite to the folding edge and two end edges defining a width of the side-wall panel that defines a height of the box; a pair of end wall panels respectively integrally connected to and extended from the end edges of the bottom panel and folded along second scored folding lines thereat; and a pair of filler beam panels connected to the end edges of each end-wall panel, each of said filler beam panels extending from said respective end edge of said end-wall panel and being folded along a third scored folding line at the end-wall panel end edge to form a hollow support beam; wherein a first pair of locking insert tabs is formed in cutting lines at predetermined locations on the side-wall panel and engaged with a first pair of holding tabs, each of which is formed at a predetermined location on the corresponding filler beam panel, and a second pair of locking insert tabs is formed at predetermined locations on said end-wall panel and engaged with a second pair of holding tabs, each of which is formed at a predetermined location on the filler beam panel so as to secure the support beams formed of the filler beam panels against the corresponding end-wall panels when the box is assembled, and wherein each locking insert tab and its corresponding holding tab are oriented in the same direction.

6. The foldable box of claim 5, wherein each of the filler beam panels is divided into four sections by scoring lines, each of the first pair of holding tabs being provided at the innermost section to the third folding line, and each of the second pair of holding tabs provided at the outermost section away from the third folding line.

7. The foldable box of claim 5, further comprising protruding tabs formed along the top edges of the end-wall panes and filler beam panes, and wherein there is a pair of openings at predetermined locations on each cover panel to respectively receive two protruding tabs of the end-wall panels and filler beam panels.

8. The foldable box of claim 5, wherein the locking insert tab is generally in form of a U-shaped cutting line, and is longer than the holding tab, while the holding tab is wider than the locking insert tab such that upon pressing the locking insert tab and the holding tab away from their original positions, the holding tab is bent into the hollow beam and leaves an opening to let the insert tab slide through, and upon releasing the pressing, a portion of the insert tab s held by the holding tab against the hollow beam.

9. The foldable box of claim 7, wherein there are formed openings on the bottom panel of the box, and the protruding tabs protrude through the openings of the cover to serve as stacking tabs to hold an upper stacked box in place.

10. A foldable tote box comprising a one-pierce die-cut board of corrugated material, said board including a rectangular bottom panel having a predetermined length and width defined by its two side edges and two end edges; a pair of side-wall panels, each having a folding edge integrally connected to the side edge of the bottom panel and being folded along a first scored folding line at the folding edge to form the side-wall of the box, each of said side-wall panels having a cover panel connected to its top edge opposite to the folding edge and two end edges defining a width of the side-wall panel that defines a height of the box; a pair of end wall panels respectively integrally connected to and extended from the end edges of the bottom panel and folded along second scored folding lines thereat; and a pair of filler beam panels connected to the end edges of each end-wall panel, each of said filler beam panels extending from said respective end edge of said end-wall panel and being folded along a third scored folding line at the end-wall panel end edge to form a hollow support beam; wherein a pair of locking insert tabs is formed in cutting lines at predetermined locations on the end-wall panel and engaged with a pair of holding tabs, each of which is formed at a predetermined location on the corresponding filler beam panel so as to secure the support beams formed of the filler beam panels against the corresponding end-wall panels when the box is assembled, and wherein each locking insert tab and its corresponding holding tab are oriented in the same direction.

11. The foldable box of claim 10, wherein each of the filler beam panels is divided into four sections by scoring lines, the sections being approximately equal with the second innermost section wider than others, each of the pair of holding tabs provided at the third section toward the third folding line, thereby said four-section filler beam panel forming a triangle hollow corner support beam.

12. The foldable box of claim 10, further comprising protruding tabs formed along the top edges of the end-wall panes and filler beam panes, and there are two pairs of openings at predetermined locations on each cover panel to respectively receive the protruding tabs of the end-wall panels and filler beam panels.

13. The foldable box of claim 10, wherein the locking insert tab is generally in form of a U-shaped cutting line, and is longer than the holding tab, while the holding tab is wider than the locking insert tab such that upon pressing the locking insert tab and the holding tab away from their original positions, the holding tab is bent into the hollow beam and leaves an opening to let the insert tab slide through, and upon releasing the pressing, a portion of the insert tab s held by the holding tab against the hollow beam.

14. The foldable box of claim 12, wherein there are openings formed on the bottom panel of the box, and the protruding tabs protrude through the openings of the cover to serve as stacking tabs to hold an upper stacked box in place.

15. A one-piece board of a foldable tote box, said board comprising a rectangular bottom panel having a predetermined length and width defined by its two side edges and two end edges; a pair of side-wall panels, each having a folding edge integrally connected to the side edge of the bottom panel and being foldable along a first scored folding line at the folding edge to form the side-wall of the box, each of said side-wall panels having a cover panel connected to its top edge opposite to the folding edge and two end edges defining a width of the side-wall panel that defines a height of the box; a pair of end wall panels respectively integrally connected to and extended from the end edges of the bottom panel and being foldable along second scored folding lines thereat; and a pair of filler beam panels connected to the end edges of each end-wall panel, each of said filler beam panels extending from said respective end edge of said end-wall panel and being foldable along a third scored folding line at the end-wall panel end edge to form a hollow support beam; wherein a first pair of locking insert tabs is formed in cutting lines at predetermined locations on the side-wall panel and engaged with a first pair of holding tabs, each of which is formed at a predetermined location on the corresponding filler beam panel so as to lock the support beams formed of the filler beam panels to the corresponding sidewall panels when the box is assembled, and wherein each locking insert tab and its corresponding holding tab are oriented in the same direction.

16. The board of claim 15, wherein the board is of corrugated plastic board that has smooth surfaces on both sides, thereby defining therebetween a plurality of flutes such that the flutes in the beams are in an upright position when the box is assembled.

17. The board of claim 15, wherein each of the filler beam panels is proportionally divided into five sections such that each of the filler beam panels can be folded to form a hollow support beam, and each of the corresponding first pair of holding tabs is provided at the innermost section to the third folding line to secure the support beams against the side-wall panels.

18. The board of claim 17, further comprising protruding tabs formed along the top edges of the end-wall panels and filler beam panels, and there are two pairs of openings formed at predetermined locations on each cover panel, thereby receiving, respectively, the protruding tabs of the end-wall panels and filler beam panels when the box is assembled.

19. The board of claim 15, further comprising a second pair of locking insert tabs formed at predetermined locations on said end-wall panel and engaged with a second pair of holding tabs, each of which is formed at a predetermined location on the filler beam panel, and wherein each of the filler beam panels is divided into four sections, and each of the corresponding first pair of holding tabs is provided at the innermost section to the third folding line, and each of the corresponding second pair of holding tabs provided at the outermost section away from the third folding line, such that each of the filler beam panels can be folded to form a hollow support beam to be secured against the end-wall panel.

20. The board of claim 19, further comprising protruding tabs formed along the top edges of the end-wall panes and filler beam panes, and there is a pair of openings at predetermined locations on each cover panel, each opening receiving two protruding tabs of the end-wall panels and filler beam panels.

21. The board of claim 15, wherein each of the filler beam panels is divided into four sections, the sections being approximately equal with the second innermost section wider than the others, and the first pair of locking insert tabs is provided on the end-wall panel rather than on the side-wall panel, and the corresponding first pair of holding tabs provided at the third section toward the third folding line instead of at the innermost section, such that said four-section filler beam panel forming a triangular hollow corner support beam to be secured against the end-wall panel, and further comprising protruding tabs formed along the top edges of the end-wall panes and filler beam panes, and there are two pairs of openings at predetermined locations on each cover panel to respectively receive the protruding tabs of the end-wall panels and filler beam panels.

22. The board of claim 15, wherein the locking insert tab is generally in form of a U-shaped cutting line, and longer than the holding tab, while the holding tab is wider than the locking insert tab such that upon pressing the locking insert tab and the holding tab away from their original positions, the holding tab can be bent into the hollow beam and leave an opening to let the insert tab slide through, and upon releasing the pressing, a portion of the insert tab sliding into the hollow beam can be held by the holding tab against inside surface of the hollow beam.

23. The board of claim 22, wherein the narrower locking insert tab includes a barbed head portion, that enables the locking tab hooked over the holding tab.

24. The board of claim 22, wherein the holding tab is made in a short U-shape cutting line such that there is a slot formed in front of the tip of the holding tab to facilitate the insertion of the locking insert tab.

25. The board of claim 15, wherein said filler beam panels are undivided corner panels, on each of which formed is one of the first pair of holding tabs to be engaged with the corresponding locking insert tab on the side-wall panel.

* * * * *